United States Patent [19]

Roche

[11] Patent Number: 4,709,187

[45] Date of Patent: Nov. 24, 1987

[54] LAMP WITH LEAD WIRE THERMAL SWITCH

[75] Inventor: William J. Roche, Essex, Mass.

[73] Assignee: GTE Products Corporation, Danvers, Mass.

[21] Appl. No.: 717,211

[22] Filed: Mar. 28, 1985

[51] Int. Cl.[4] ..... H05B 41/18

[52] U.S. Cl. ..... 315/74; 315/73; 315/106; 315/107; 337/27

[58] Field of Search ..... 315/73, 74, 106, 107; 337/22, 23, 24, 25, 26, 27

[56] References Cited

U.S. PATENT DOCUMENTS

| | | | |
|---|---|---|---|
| 2,267,098 | 12/1941 | Hays, Jr. | 337/27 X |
| 2,269,843 | 1/1942 | Carpenter et al. | 337/27 X |
| 4,156,831 | 5/1979 | Cassidy et al. | 315/106 |
| 4,211,958 | 7/1980 | Bickford et al. | 315/74 X |
| 4,481,446 | 11/1984 | Tsuchihashi et al. | 315/73 |
| 4,572,986 | 2/1986 | Sindlinger | 315/73 X |

*Primary Examiner*—Larry Jones

*Attorney, Agent, or Firm*—Thomas H. Buffton; Carlo S. Bessone

[57] ABSTRACT

A rapid-start fluorescent lamp has a tubular envelope with a phosphor-coated inner wall, a pair of spaced electrodes and a pair of electrical leads sealed into the ends of the envelope with one electrical lead directly connected to the electrode and the other electrical lead connected through a bi-metal circuit breaker to the electrode with the circuit breaker formed to open-circuit at a given range of temperatures. Also, the discharge lamp is fabricated by preparing a phosphor coated envelope, forming a pair of end members having a pair of electrical leads, a bi-metal circuit breaker and electrode, sealing the end members into the envelope, heating and exhausting the envelope, heating the electrodes, dispensing a fill gas and mercury into the envelope, pinching off the exhaust tubes of the envelope and severing the fuse member of the circuit breaker.

6 Claims, 3 Drawing Figures

LAMP WITH LEAD WIRE THERMAL SWITCH

TECHNICAL FIELD

This invention relates to rapid-start fluorescent lamps and more particularly to rapid-start fluorescent lamps and the manufacture thereof wherein a bi-metal circuit breaker is incorporated into the lead wires within the lamp.

BACKGROUND ART

In the fluorescent lamp art, both preheat type lamps and rapid-start type lamps are commonly encountered. In the preheat type of discharge lamp, heater current flowing through the electrodes only during lamp ignition. Thereafter, it is a common practice to provide an external voltage sensitive starter which opens the heater current circuit discontinuing heater current flow. In contrast, a rapid-start type fluorescent lamp normally has a constant heater current flow through each electrode both during ignition and during operation of the lamp. Unfortunately, heater current flow during operation of a rapid-start fluorescent lamp is lost power which obviously reduces efficiency of the discharge lamp.

Numerous suggestions have been made by enhancing the efficiency of rapid-start fluorescent lamps. For example, U.S. Pat. Nos. 4,052,687; 4,097,779; 4,114,968; 4,156,831 and 4,171,519, all assigned to the Assignee of the present Application, suggest numerous configurations for enhanced operation of rapid-start fluorescent lamps. Generally, each provides a thermally responsive circuit breaker suitable for use in discontinuing heater current when the fluorescent lamp becomes operational.

Although each of the above-listed structures and techniques provides discharge lamps having numerous advantages over prior known configurations and processes, it has been found that problems remain. More specifically, it has been found that a configuration wherein a separate capsule containing a circuit breaker arrangement, which is attached to the inner leads of a fluorescent lamp, does present problems. For instance, attaching a separate capsule containing a circuit breaker requires a cut-out of the inner lead of the discharge device. However, severing the inner lead to facilitate this addition tends to undesirably weaken the support structure for the attached electrode which is obviously an undesirable result. Also, a separate apparatus is required to fabricate a separate capsule and a separate feed system must be utilized to add the capsule to the lamp fabrication operation.

OBJECTS AND SUMMARY OF THE INVENTION

One object of the present invention is to provide an improved rapid-start fluorescent lamp. Another object of the invention is to increase the efficiency of a rapid-start fluorescent lamp. Still another object of the invention is to provide an improved process for manufacturing rapid-start fluorescent lamps. A further object of the invention is to provide an integral circuit breaker and rapid-start fluorescent lamp.

These and other objects, advantages and capabilities are achieved in one aspect of the invention by a rapid-start fluorescent lamp having an elongated tubular envelope with a phosphor-coated inner surface, a pair of spaced electrodes therein, and a pair of electrical leads sealed into and passing through each end of the elongated envelope with one lead directly connected to the electrode and the other lead having a circuit breaker formed therein and connected to the electrode wherein the circuit breaker includes a bimetal strip shunted by a severable fuse wire.

In another aspect of the invention, a process for fabricating a rapid-start fluorescent lamp includes the steps of forming a tubular glass envelope with an interior phosphor-coated film, forming end members with a pair of electrical leads sealed therein and passing therethrough, an electrode directly connected to one of the electrical leads and a circuit breaker integral to the other lead and connected to the electrode, sealing the end members into the envelope, heating and exhausting the envelope, heating the electrodes, dispensing a fill gas and mercury, pinching off the exhaust tubes of the envelope, and energizing a fuse member of the circuit breaker to sever the fuse member.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
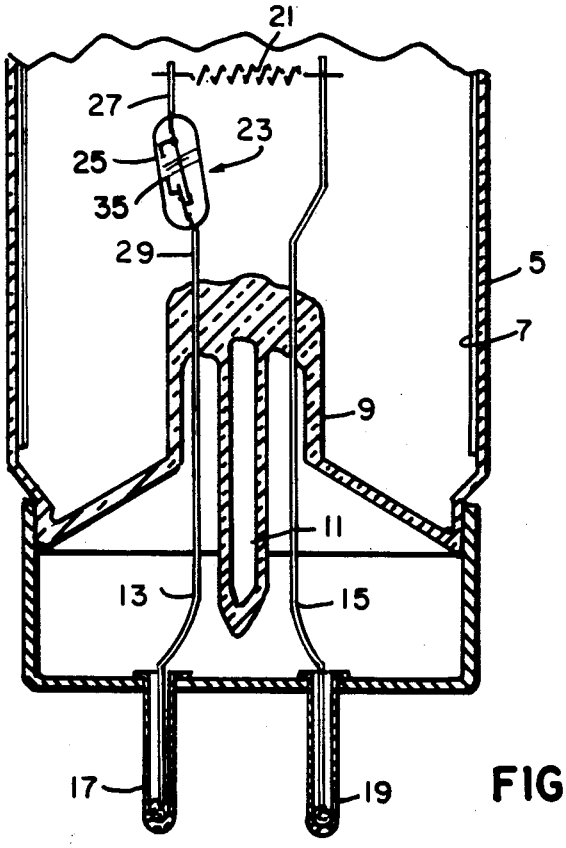
FIG. 1 is a elevational view, partially in section, of one end of a rapid-start fluorescent lamp having an integral circuit breaker array.
Figure 2:
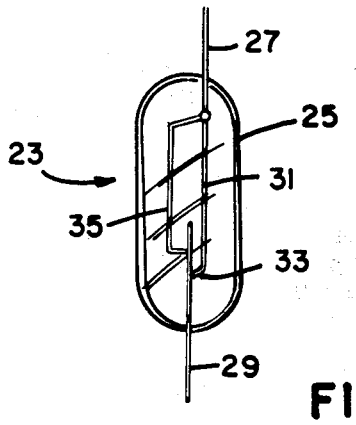
FIG. 2 is an enlarged view of the circuit breaker of FIG. 1.
Figure 3:
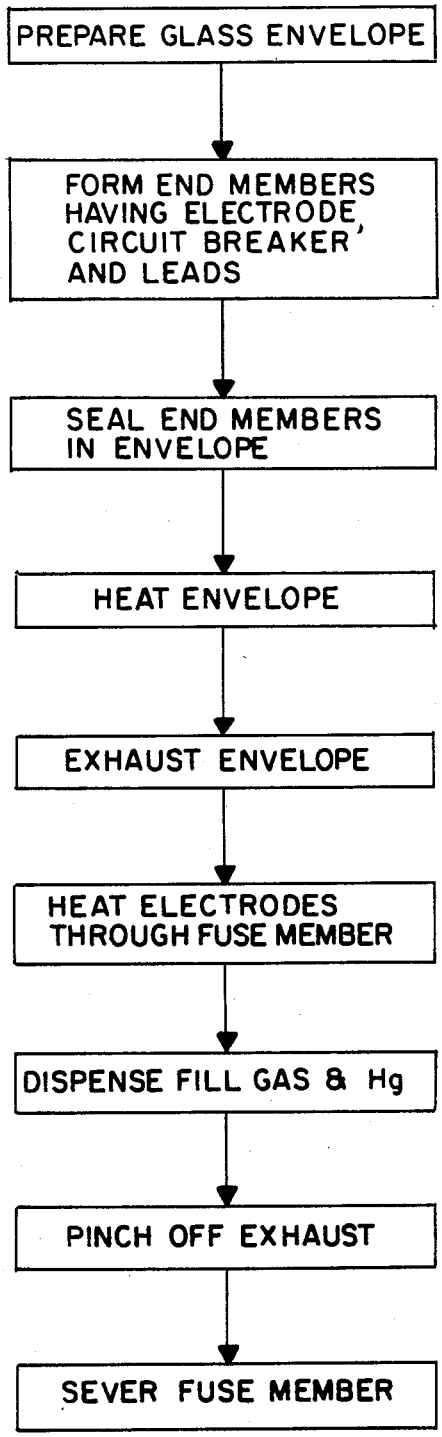
FIG. 3 is a flow chart illustrating a process of manufacture for rapid-start fluorescent lamps.

Referring to FIGS. 1 and 2 of the drawings, a rapid-start fluorescent lamp includes an elongated tubular glass envelope 5 having an inner wall surface with a phosphor coating 7 thereon. An end member 9 is sealed into each end of the envelope 5 and includes an exhaust tube portion 11 and a pair of electrical conductors 13 and 15 sealed therein and passing therethrough. The electrical conductors 13 and 15 are connected to external pins 17 and 19 suitable for attachment to an energizing source.

Within the glass envelope 5 is a fill gas selected from the group consisting of argon, krypton, neon, helium, xenon and combinations thereof with mercury. An electrode 21 is disposed within the envelope 5 and has one end thereof directly connected to lead 15 of the pair of electrical leads 13 and 15. The electrode 21 extends in a direction substantially normal to the longitudinal axis of the envelope 5 with the other end thereof connected to the other lead 13 of the pair of electrical leads 13 and 15 by way of an integral circuit breaker 23.

The circuit breaker 23 includes a glass bulb 25, in this example, having first and second leads 27 and 29 respectively sealed therein and passing therethrough. The first lead 27 directly connects the circuit breaker 23 to the electrode 21 while the second lead 29, which is sealed directly into one end of envelope 15, connects to lead 13 of the pair of electrical conductors 13 and 15. A bimetal strip 31 is located within the glass bulp 25 and connected to the first lead 27. This bimetal strip 31 has an angular portion 33 of about 45° and is formed to provide edge contact with the second capsule lead 29 within the bulb 25. Also, a fuse wire 35 is affixed to the first lead 27 and to the second lead 29 connected to the electrical conductor 13. Moreover, this fuse wire 35 is severed upon completion of the process of manufacture of the rapid-start fluorescent lamp.

As the manufacture of the above-described rapid-start fluorescent lamp, an elongated tubular glass envelope with a phosphor-coated inner wall surface is prepared. Also, a pair of end members for the envelope are formed and include a pair of electrical conductors within the envelope and an electrode connected directly to one of the electrical conductors and to the circuit breaker integral to the other electrical conductor. An exhaust tube extends outwardly from each of the end members.

The end members are sealed into opposite ends of the elongated envelope and the envelope is heated and then exhausted by way of the exhaust tubes. Thereafter, the electrodes are heated and processed by the application of current thereto via the fuse member of the circuit breaker and the electrical leads. Following, a fill gas and mercury is dispensed into the envelope and the envelope is sealed by pinching off the exhaust tubes. Finally, the fuse member is severed by the application thereto of a current available from an energy source (not shown) connected to the electrical leads 13 and 15 of FIG. 1. A first portion and a second portion of severed fuse wire 35 is shown in FIG. 1 each affixed to a respective one of the pair of spaced leads 27 and 29.

As to operation, the bimetal strip 31 serves to provide a conductive path for the filament voltage applied to lamp base pins 17 and 19 in order to preheat electrode 21 prior to ionization of the gas-filled discharge device. As the lamp becomes conductive and heat develops, the bimetal strip 31 reaches a temperature in the range of about 120° to 160° C. whereupon the bimetal 31 is deflected and the electrical path to the electrode 21 from the base pins 17 and 19 is interrupted. Thus, operation of the discharge lamp continues via filament lead wire 15 without benefit or need of application of external energy to the electrode 21.

Thus, a rapid-start fluorescent lamp has been provided having an integral bi-metal circuit breaker arrangement. This circuit breaker arrangement insures the operation of the discharge lamp without the need for a continuous energy supply to the lamp electrodes. Accordingly, lamp efficiency is enhanced and operational capabilities improved.

While there has been shown and described what is at present considered the preferred embodiments of the invention, it will be obvious to those skilled in the art that various changes and modifications may be made therein without departing from the invention as defined by the appended claims.

I claim:

1. A rapid-start fluorescent lamp comprising:

an elongated tubular glass envelope having a phosphor-coated inner wall surface;

a pair of spaced electrodes positioned within the ends of said elongated tubular glass envelope;

a pair of electrical leads sealed into and passing through each end of said elongated tubular glass envelope and formed for connection to an external energizing source, one of said pair of electrical leads at each end of said envelope being directly connected to one of said pair of spaced electrodes and the other one of said pair of electrical leads at each end of said envelope including a circuit breaker therein connecting said electrical lead to the opposite end of one of said pair of spaced electrodes, said circuit breaker including a pair of spaced leads with one of said leads sealed directly into one end of said envelope and connected to said one of said pair of electrical leads and the other one of said leads directly connected to one of said pair of electrodes and a bimetal strip affixed to one of said pair of spaced leads and formed to contact the other one of said pair of spaced leads at a temperature below a given range of temperatures and to discontinue said contact within said given range of temperatures.

2. The rapid-start fluorescent lamp of claim 1 wherein said circuit breaker is sealed into a glass bulb.

3. The rapid-start fluorescent lamp of claim 1 wherein the circuit breaker is formed for edge contact between said bimetal strip and said other one of said pair of spaced leads.

4. The rapid-start fluorescent lamp of claim 2 wherein said given range of temperatures for effecting a disconnection of said bimetal strip from said other one of said pair of spaced leads is in the range of about 120° to 160° C.

5. The rapid-start fluorescent lamp of claim 2 wherein said bimetal strip has a foot-portion formed at an angle of about 45° to provide edge contact thereof with said other one of said pair of spaced leads.

6. The rapid-start fluorescent lamp of claim 2 wherein said circuit breaker has a severed fused wire with a first portion and a second portion each affixed to one of said pair of spaced leads of said circuit breaker.

* * * * *